United States Patent [19]

Meinerding et al.

[11] 4,185,577

[45] Jan. 29, 1980

[54] VESSEL MOORING DEVICE

[76] Inventors: Wesley C. Meinerding, 1019 Knollwood Rd. NW.; Edgar Hensley, 4957 Aurora NW., both of Canton, Ohio 44708

[21] Appl. No.: 329,139

[22] Filed: Aug. 30, 1977

[51] Int. Cl.[2] ..... B63B 21/00

[52] U.S. Cl. ..... 114/230

[58] Field of Search ..... 114/230, 242, 249, 253

[56] References Cited

U.S. PATENT DOCUMENTS

| | | | |
|---|---|---|---|
| 2,552,424 | 5/1951 | Gorman | 114/230 |
| 2,912,953 | 11/1959 | Olsen | 114/230 |
| 3,103,005 | 9/1963 | Hills | 114/253 X |
| 3,122,120 | 2/1964 | Jorgenson | 114/230 |

*Primary Examiner*—Stephen G. Kunin
*Assistant Examiner*—Sherman D. Basinger
*Attorney, Agent, or Firm*—Hamilton, Renner & Kenner

[57] ABSTRACT

A device for mooring a vessel including a mounting assembly adapted for attachment to a dock, an assembly for selective attachment to and detachment from the vessel, a strut rigidly attached to and extending from the assembly for selective attachment to and detachment from the vessel, and a motion damping assembly interposed between and rigidly attached to the strut and the mounting assembly, said motion damping assembly having a stranded cable providing three dimensional damping of the motion of the vessel.

4 Claims, 5 Drawing Figures

VESSEL MOORING DEVICE

BACKGROUND OF THE INVENTION

The invention relates generally to a mooring device for securing vessels to piers or docks. More particularly, the invention relates to a mooring device which provides damping for a vessel moored to a fixed or movable dock or pier configuration. More specifically, the invention concerns a mooring device usable alone or with other identical or differing mooring devices to provide three dimensional damping and restraint for a vessel in varying water conditions.

The mooring of vessels has undergone little evolution over the years. In general, various combinations of mooring lines and fenders have been employed in combinations dictated by the particular configuration of the vessel and the mooring berth. In regard to various types of ships, a plurality of mooring lines are normally used in conjunction with a plurality of strategically placed fenders. The mooring lines provide restraint for the distance that the vessel is displaced from a pier or dock in one or more general directions. Normally a plurality of fenders are employed at selected positions on the pier or dock to prevent the vessel from coming into direct contact with the pier or dock during the inevitable movements proximate thereto. Improvements in the mooring of large ships according to the foregoing has been largely limited to improvements in the configuration of and materials from which fenders are fabricated and the use of synthetic fibers to provide an extent of resilience in mooring lines.

The mooring of relatively small ships and boats has generally followed a comparable pattern. In many instances mooring techniques have evolved around the use of smaller sized mooring lines and fenders comparable to those used in the handling of larger ships. In the case of relatively small craft efforts have been made to employ mooring lines in combination with rigid structural members which maintain the craft a minimum fixed distance from a pier or dock but permit an extent of vertical motion to accommodate wave conditions and perhaps minor tidal variations. An example of such rigid structural members involves a triangular support attached at two points to a pier or dock with the third point of the triangle attached to an oar lock or other fitting on the boat.

The various types of mooring discussed above have suffered the common disability of requiring frequent supervision to adjust for variations in water conditions, wind direction, tide and other factors. In order to avoid the requisite supervision or the alternative damage to piers or docks or vessels or both, a number of types of hoists have been developed for small to medium-sized boats which permit suspension of a boat above the water proximate a dock or pier facility. Such suspension devices, besides being relatively expensive in comparison with conventional mooring equipment are substantially less convenient and require more extensive maintenance. As a result of the above factors the various prior art approaches to the mooring particularly of small boats has not produced a device which has satisfied the various requirements and achieved broad commercial acceptance.

SUMMARY OF THE INVENTION

Accordingly, it is an object of the present invention to provide a mooring device for vessels which is capable of being used in conjunction with a range of vessel sizes and which can be designed to handle different ranges merely by varying the size characteristics of the components. It is a further object of the present invention to provide a mooring device which can be employed in conjunction with other identical or similar mooring devices or in conjunction with conventional mooring devices such as lines or fenders, normally in lesser numbers than would otherwise be required. It is another object of the present invention to provide a single mooring device which provides three-dimensional damping characteristics at a single vessel attachment point. It is a still further object of the present invention to provide a mooring device wherein severe displacement motions in any of three axial directions are heavily damped and wherein relatively smaller displacements are relatively undamped.

An additional object of the invention is to provide a mooring device which permits quick and easy securing and release of a vessel. Still another object of the invention is to provide a mooring device which requires a minimum of dynamic travel and which may be otherwise quite compact. Another object of the invention is to provide a mooring device which is substantially unaffected by water, salt spray, petroleum products, temperature variations and other conditions normally encountered in a marine environment. Still another object of the present invention is to provide a mooring device which has a virtually unlimited service life without operational deterioration, which can be mounted in any orientation for adaptability to wide variations in pier and vessel configurations and which can be relatively inexpensively manufactured.

These and other objects of the present invention, together with the advantages thereof over the existing and prior art forms which will become apparent from the description to follow, are accomplished by the mooring device hereinafter shown, described and claimed.

In general, a mooring device employing the concepts of the present invention includes a mounting assembly adapted for attachment to a dock, an assembly for selective attachment to and detachment from the vessel, strut means rigidly attached to and extending from the assembly for selective attachment to and detachment from the vessel, and a motion damping assembly interposed between and rigidly attached to the strut and the mounting assembly, said motion damping assembly having a stranded cable providing three dimensional damping of the motion of the vessel.

DESCRIPTION OF THE PREFERRED EMBODIMENT

Figure 1:
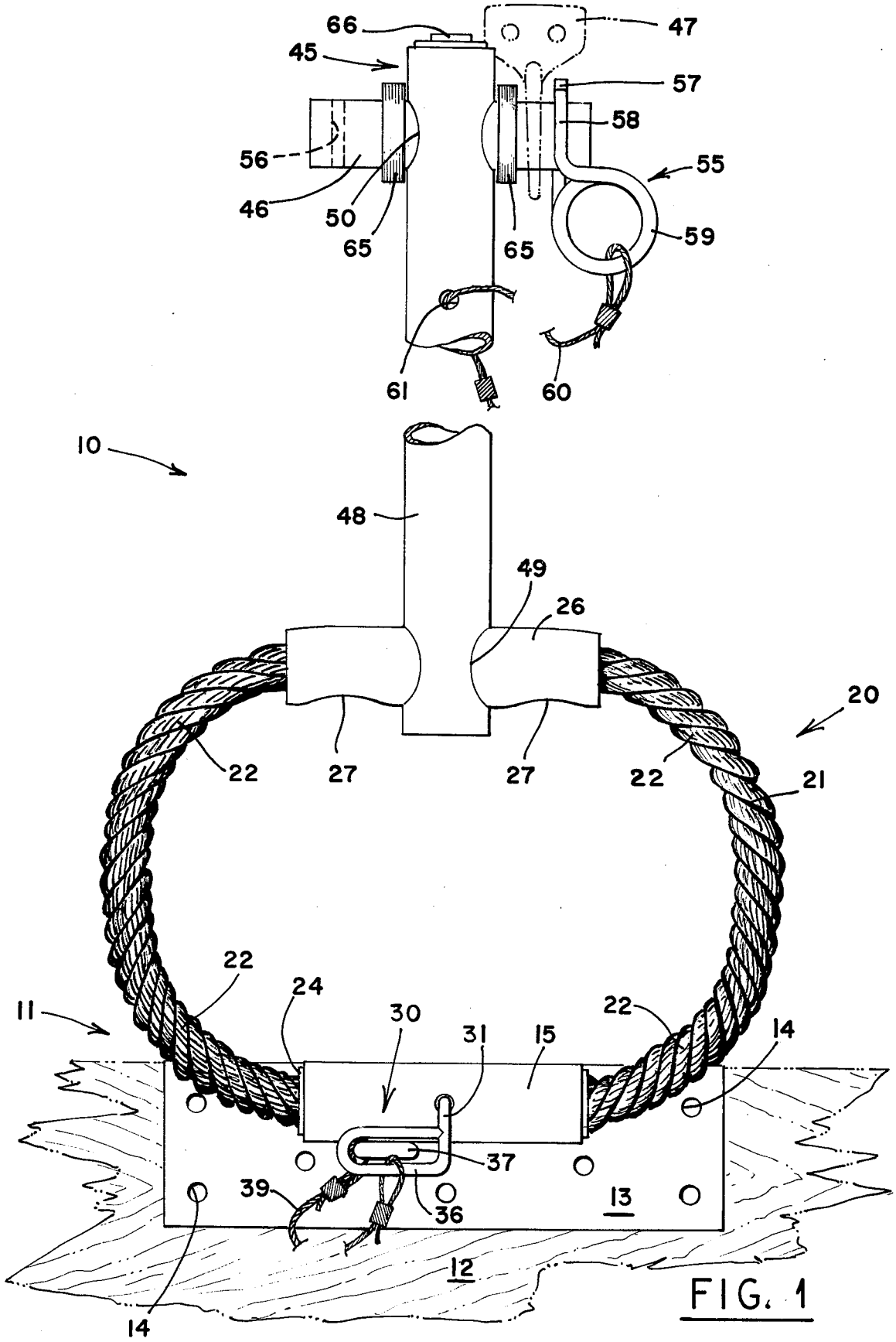
FIG. 1 is a top plan view of a vessel mooring device embodying the concepts of the present invention with an exemplary attachment for a dock or pier depicted at one extremity thereof and with an exemplary attachment for an eye affixed to a vessel being depicted at the opposite extremity thereof.
Figure 2:
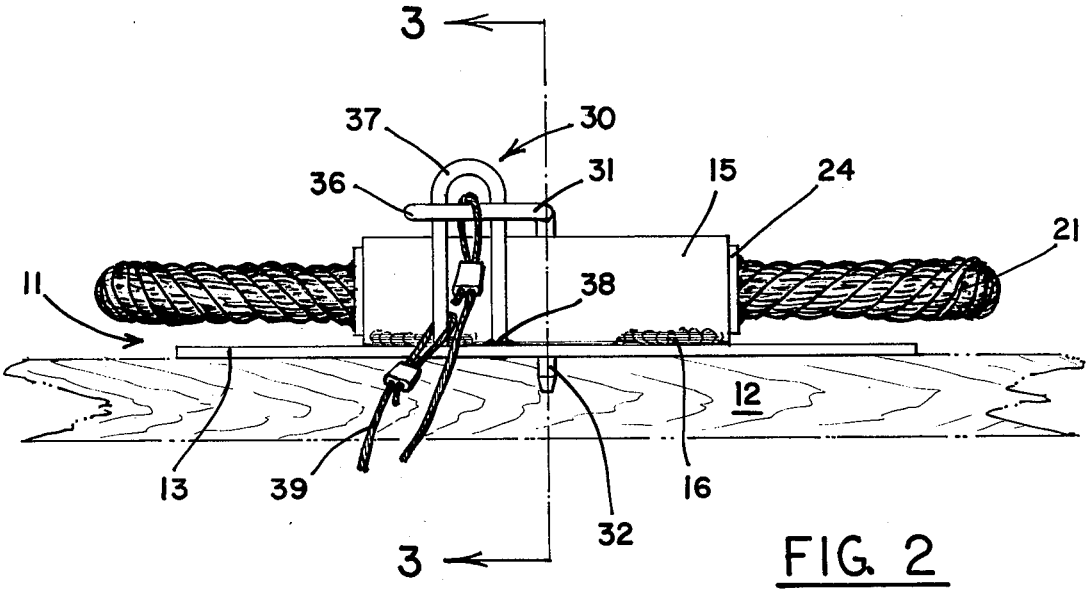
FIG. 2 is a front elevational view of the extremity of the mooring device of FIG. 1 which is for attachment to a pier or dock and depicting particularly the rotational locking assembly thereof.
Figure 3:
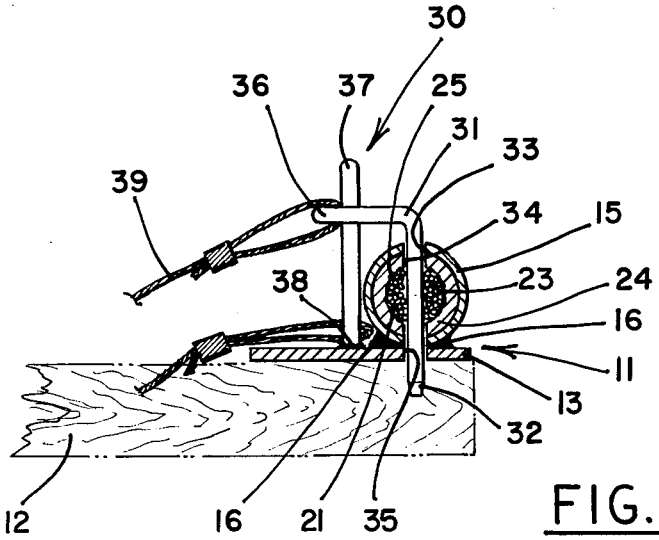
FIG. 3 is a sectional view taken substantially along the line 3—3 of FIG. 2.

Referring now to the drawings and particularly to FIGS. 1–3 thereof, that embodiment of the vessel mooring device according to the present invention is indicated generally by the numeral 10. The mooring device 10 is preferably of a somewhat elongate configuration for purposes of maintaining a vessel a predetermined spaced distance from a pier or dock subject to an extent of resilient deflection inwardly or outwardly thereof, thereby maintaining a minimum clearance between the pier or dock and the moored vessel at all times. One longitudinal extremity of the mooring device 10 is a dock mounting assembly generally indicated by the numeral 11 which is adapted to be attached to a portion of an exemplary dock or pier 12 depicted in chain lines in the Figs. For purposes of rigidly attaching the mooring device 10 to the dock or pier 12, the dock mounting assembly has an attachment bracket 13 which may take the form of a flat plate, as shown, or other configuration in express conformance with a particular pier or dock member. As shown, the attachment bracket 13 has a plurality of bores for purposes of receiving fasteners (not shown) such as screws or bolts which may be extended therethrough and attached to the dock or pier 12. Although the attachment bracket 13 is shown fixed to a horizontal pier or dock member, it is to be appreciated that attachment to a vertical or otherwise oriented pier or dock member could be readily effected without adversely influencing the operation of the mooring device 10 and with a minimum of modification thereto.

The dock mounting assembly 11 has a tubular housing 15 positioned on and rigidly fixed to the attachment bracket 13. The tubular housing 15 may be conveniently affixed proximate the outboard extremity of attachment bracket 13 as by suitable welds 16 seen in FIGS. 2 and 3.

The housing 15 of dock mounting assembly 11 interconnects with the motion damping assembly generally indicated by numeral 20 in FIG. 1. The resilient member of the motion damping assembly 20 is the cable 21. The cable 21 is preferably a stranded steel configuration which may be made of stainless steel for purposes of optimizing resistance to water and other elements of the marine environment. For purposes of mooring small to medium sized boats, it has been found that one-half inch diameter steel cable composed of six strands, each consisting of eighteen to twenty wires, provides satisfactory results in terms of damping control characteristics and service life. It is to be appreciated that, depending upon the particular application which might be involved, the size of the cable, the number of strands, the number of wires per strand, the size of the wire, the cable twist or lay, or other variables known to persons skilled in the art could be altered or adjusted to meet the particular mooring characteristics which might be involved depending upon the number and positioning of the mooring devices 10, the size of a vessel, and the range of water conditions to be accommodated within the design characteristics of the system.

The preferred form of the invention of FIG. 1 depicts the cable 21 as being of an oblate circular or loop configuration wherein the longer dimension extends laterally of the longitudinal dimension of the mooring device 10. This configuration provides the desired three dimensional damping qualities with the four curved corners 22 handling tension and compression force components applied longitudinally of the mooring device 10.

As shown, the cable 21 is a single length of wire rope having the extremities 23 thereof inserted in a pier-end securing sleeve 24 as best seen in FIG. 3. In order to prevent slippage of the cable 21 relative to the pier-end securing sleeve 24 and to provide damping resistance for vertical displacement, the extremities 23 of a cable 21 are rigidly and non-rotatably secured within the pier-end securing sleeve 24 as by the brazing 25 (see FIG. 3) or other appropriate fastening technique. The cable 21 is preferably substantially diametrically opposite the pier-end securing sleeve 24 in a vessel end securing sleeve 26. The securing sleeves 24 and 26 may be of approximately the same length and of such an extent that they form the flat areas of the oblate sphere or loop configuration of the cable 21.

The vessel-end securing sleeve 26 is crimped or swaged at 27, preferably proximate each extremity, so that the cable 21 is non-rotatably secured therein, again for the purpose of providing damping resistance to vertical displacement components transmitted through sleeve 26 to the motion damping assembly 20. It is to be appreciated that crimping, braising or other fastening techniques or combinations thereof may be employed to ensure the non-rotational securing of the cable 21 relative to each of the sleeves 24,26. It should also be appreciated that the configuration of FIG. 1 could be made up of two lengths of cable 21 rather than a single length with the extremities of each of the cables being secured in the sleeves 24,26. With the cable 21 thus secured between sleeves 24,26 it can be seen that the cable 21 operates to dissipate motion components in any of three directions based upon compression, tension and shear force components.

The pier-end securing sleeve 24 of motion damping assembly 20 is journaled in the tubular housing 15 for purposes of selectively permitting an extent of rotation between the dock mounting assembly 11 and the motion damping assembly 20. The possibility of selectively permitting an extent of rotation to accommodate vertical displacement of a vessel, particularly during mooring operations, is advantageous for purposes of attaching the mooring device 10 to a vessel in the manner hereinafter described to provide compensation for normal vertical motion of a vessel even during relatively calm water conditions.

In normal operation, however, it is desirable that all force damping be effected by the cable 21 of the motion damping assembly 20 via the selective absence of relative rotation between pier-end securing sleeve 24 of motion damping assembly 20 and tubular housing 15 of dock mounting assembly 11 is effected by a rotation locking assembly generally indicated by the numeral 30. The rotation locking assembly has a lock pin 31 which has a tongue portion 32 that extends through bores 33 and 34 in the tubular housing 15 and the pier-end securing sleeve 24, respectively (as seen in FIG. 3). The bores 33 and 34 may, as shown in FIG. 3, be through bores and a bore 35 may be provided in attachment bracket 13 so that tongue 32 of lock pin 31 extends entirely therethrough for purposes of optimizing available contact area to maintain the cable 21 in the position depicted in FIG. 2. In order to maintain locking pin 31 in the locked position depicted in FIG. 3, the end opposite the tongue 32 has a loop or hasp portion 36 which overfits a staple 37 rigidly attached to the fastening plate 13 as by welds 38. Although ordinarily unnecessary, a lock or pin could be inserted through the staple 37 above the hasp portion 36 or lock pin 31 for purposes of insuring that the lock pin 31 is not moved upwardly upon intermittent loading conditions imposed on the pier-end securing sleeve 24 through the cable 21. The lock pin 31 may be provided with a conventional safety cable to prevent its being lost in the water or otherwise misplaced. As shown, the safety cable may be conveniently secured about the hasp portion 36 of lock pin 31 and the staple 37 and is of sufficient length to permit operation of the lock pin 31 while maintaining it in the proximity for ready access.

The extremity of the mooring device 10 opposite the dock mounting assembly 11 has a vessel spacing and attachment assembly generally indicated by the numeral 45. The vessel spacing and attachment assembly 45 has an engaging arm 46 which may be a solid or tubular member and which is adapted to attach to a vessel as, for example, by extending through a conventional vessel mounted eye fitting 47 shown in chain lines in FIG. 1.

The engaging arm 46 is joined to and spaced a predetermined distance from the motion-damping assembly 20 by a strut 48. The strut 48 could conveniently be a tubular member having the vessel end securing sleeve 26 of motion damping assembly 20 rigidly affixed thereto. This rigid attachment may be effected by a bore 49 through strut 48 accommodating the sleeve 26 and being internally brazed thereto (not shown). Preferably proximate to but spaced from the end of strut 48 opposite the sleeve 26, the engaging arm 46 may be similarly received in a bore 50 with internal brazing (not shown) similarly effecting a rigid attachment. The engaging arm 46 preferably extends a distance to either side of the strut 48 such as to permit either extremity to be inserted in the vessel mounted receiver such as the eye fitting 47.

For purposes of maintaining eye fitting 47 in position on either extremity of engaging arm 46, a lock ring generally indicated by the numeral 55 is provided for insertion into through bores 56 provided in each of the projecting extremities of the engaging arm 46. The lock ring 55, as shown, is provided with the threading leg 57 adapted to be positioned in the through bores 56 and a pressure leg 58 adapted to engage the outer surface of the engaging arm 46, in conforming configuration thereto, if desired. The threading leg 57 and pressure leg 58 of lock ring 55 are urged together for pressure retention on the engaging arm 46 by a spring connector 59 interconnecting the legs 57,58. The lock ring 55 may be provided with a safety cable 60 attached through the spring 59 and affixed through a bore 61 in the strut 48 to effect the same purposes as the safety cable 39 employed in conjunction with the lock pin 31.

If desired annular grommets 65 may be positioned on either extremity of the engaging arm 46 proximate the strut 48. The grommets 65 serve to reduce noise and abrasion which might otherwise be created between the eye fitting 47 and the strut 48 of the vessel spacing and attachment assembly 45. Similarly, a resilient plug 66 may be inserted in the end of the strut 48 for the purpose of reducing the effect of impact with either a vessel or an adjacent fitting mounted thereon. Other than the grommets 65 and plug 66 which are preferably of a marine environment resistant elastomeric compound, the remainder of the components besides the aforespecified cable 21 may advantageously be constructed of stainless steel or other marine environment resistant metals.

Figure 4:
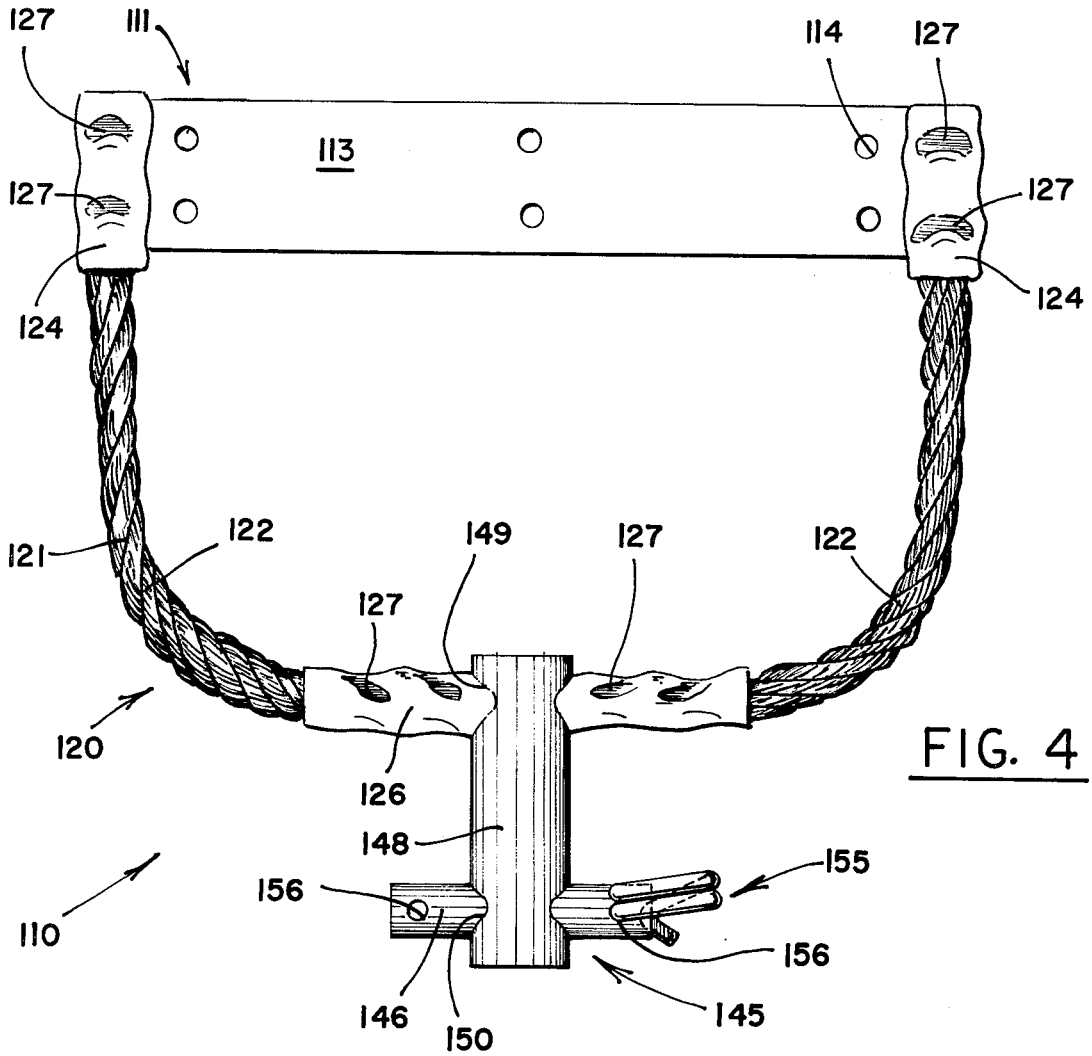
FIG. 4 is a top plan view similar to FIG. 1 depicting certain concepts of another embodiment of the present invention.
Figure 5:
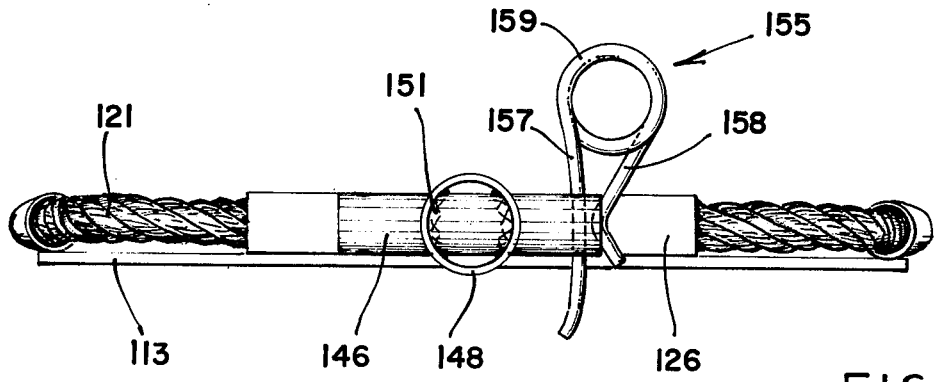
FIG. 5 is an elevational view of the mooring device of FIG. 4 viewed from the vessel attachment extremity with an exemplary lock ring in position therein.

FIGS. 4 and 5 of the drawings, disclosing another embodiment of the present invention, depict certain alternate features with the vessel mooring device thereof being indicated generally by the numeral 110. One longitudinal extremity of the mooring device 110 is the dock mounting assembly, generally indicated by the numeral 111. The dock mounting assembly 110 has an attachment bracket 113 which may be a flat plate generally similar to the attachment bracket 13 with bores 114 to accommodate fasteners for attachment to a dock or pier in the manner contemplated in the embodiment of FIGS. 1-3.

The vessel mooring device 110 has a motion damping assembly generally indicated by the numeral 120 with a resilient member in the form of a cable 121 which may be constituted similar to the cable 21. As shown, the cable 121 is a single length of wire with the extremities thereof inserted in a pair of pier-end securing sleeves 124. In a manner comparable to the sleeve 24, the sleeves 124 rigidly and non-rotatably secure the cable 121 therein as by crimping or swaging at 127. The securing sleeves 124 are rigidly attached, as by brazing (not shown), to the attachment bracket 113 of the dock mounting assembly 111.

The motion damping assembly 120 has a vessel end securing sleeve 126 which is crimped or swaged at 127 comparable to the securing sleeve 126 so that the cable 121 is non-rotatably secured therein. It should be appreciated that the configuration of FIGS. 4 and 5 could be made up of two lengths of cable 121 rather than a single length with one extremity of each of the cables being secured in the sleeve 126 and with the second extremity of each being secured in one of the sleeves 124. It is also to be noted that the resilient cable member 121 of this embodiment of the invention is generally U-shaped rather than oval in overall configuration. Thus, the cable 121 has only two curved corners 122 rather than the four corners 22 in the embodiment of FIGS. 1-3, such that it is more advantageously employed in operational environments where the tension and compression forces applied longitudinally of the mooring device are somewhat less severe.

The extremity of the mooring device 110 opposite the dock mounting assembly 111 is a vessel spacing and attachment assembly, generally indicated by the numeral 145. In the form shown the vessel spacing and attachment assembly 145 has an engaging arm 146 which may be a solid or tubular member and which is adapted for attachment to a vessel in the manner depicted in conjunction with the discussion of the embodiment of the invention of FIGS. 1-3. The engaging arm is joined to but spaced from the motion damping assembly a predetermined desired distance for a given installation by a strut 148. The strut 148 has the securing sleeve 126 rigidly affixed thereto by passing it through a bore 149 through strut 148 and being internally brazed thereto (not shown). Preferably, proximate to but spaced from the extremity of strut 148 opposite the sleeve 126, the engaging arm 146 may be similarly received in a bore 150 with internal brazing 151 similarly effecting a rigid attachment.

For purposes of maintaining the eye fitting of a vessel in position on engaging arm 146 in a manner described in conjunction with the embodiment of FIGS. 1-3 of the invention, a lock ring, generally indicated by the numeral 155, is provided for insertion in the through bores 156 provided in each of the projecting extremities of the engaging arm 146. The lock ring 155 is provided with a threading leg 157 and a pressure leg 158, in this case adapted to engage the outer extremity of the engaging arm 146. The threading leg 157 and the pressure leg 158 of lock ring 155 are urged together for pressure retention on the engaging arm 146 by the spring connector portion 159 interconnecting the legs 157,158.

Thus it should be apparent from the foregoing description of the embodiments of the invention of FIGS. 1-3 and FIGS. 4-5 that the mooring devices herein described accomplish the above enumerated and other objects of the invention.

What is claimed is:

1. Apparatus for mooring a vessel comprising, mounting means adapted for attachment to a dock, means for selective attachment to and detachment from the vessel, strut means rigidly attached to and extending from said means for selective attachment to and detachment from the vessel, and motion damping means interposed between and rigidly attached to said strut means and said mounting means, said motion damping means having a stranded cable providing three dimensional damping of the motion of the vessel, having first sleeve means rigidly securing said stranded cable and rigidly secured to said strut means and having second sleeve means rigidly securing said stranded cable and selectively rotatably journaled in housing means affixed to said mounting means.

2. Apparatus according to claim 1, including rotation locking means interacting with said housing means and said second sleeve means.

3. Apparatus according to claim 2, wherein said rotation locking means is a lock pin extensible through bores in said housing means and said second sleeve means.

4. Apparatus according to claim 3, wherein said lock pin has a hasp portion overfitting a staple attached to an attachment bracket of said mounting means for securing said lock pin in its locked position.

* * * * *